United States Patent [19]

Ishii

[11] 4,308,529

[45] Dec. 29, 1981

[54] MOTOR ACTUATED BELL

[75] Inventor: Tadashi Ishii, Tokyo, Japan

[73] Assignee: Kobishi Electric Co., Ltd., Tokyo, Japan

[21] Appl. No.: 168,422

[22] Filed: Jul. 10, 1980

[30] Foreign Application Priority Data

Jul. 3, 1980 [JP] Japan ..... 55-93988[U]

[51] Int. Cl.[3] ..... G10K 1/064

[52] U.S. Cl. ..... 340/396; 340/392; 340/402

[58] Field of Search ..... 340/392, 396, 402, 398; 116/148, 152, 154, 155

[56] References Cited

U.S. PATENT DOCUMENTS 4,183,018 1/1980 Sakaguchi ..... 340/396

*Primary Examiner*—Harold I. Pitts

*Attorney, Agent, or Firm*—Darby & Darby

[57] ABSTRACT

A motor actuated bell which comprises a gong having an extension at a predetermined inner surface thereof; an electric motor having a drive shaft; transmission means for transmitting torque of said electric motor to a slotted ring to impart an angular moment to the ring. The transmission means has a projecting portion formed thereon to engage with the slot of the ring and a hammer for striking said gong at the extrusion of the inner surface in circular movement relation therewith. A connecting member operatively connects said hammer to said slotted ring. The motor actuated bell may preferably be used in a fire bell, an alarm bell or the like.

4 Claims, 5 Drawing Figures

MOTOR ACTUATED BELL

BACKGROUND OF THE INVENTION

The present invention generally relates to motor actuated bells and, more particularly though not exclusively to motor actuated bells such as may be employed in a fire bell, an alarm bell or the like.

A typical arrangement of a conventional motor actuated bell as shown in FIG. 1, where a gong is omitted to illustrate briefly the mechanism of the bell, comprises: a motor 100 having a motor shaft 101, on which a worm gear 102 is fixedly mounted; a convertion means composed of a worm wheel 103 and a cam 105 both of which fixedly mounted on a drive shaft 104, the worm wheel 103 being mated with the worm gear 102 to transmit the rotational movement of the motor shaft 101 to the drive shaft 104 in a reduced speed; and a hammer 106 one end of which serves as a cam follower in contact with the surface of the cam 105, the other end of which strikes against an associated gong (not shown) resisting against the bias strength of a coil spring 107 to generate bell sounds.

A motor actuated bell thus constructed operates in such a manner as the motor 100 is driven to rotate the cam 105 through the meshed gears 102 and 103, and the cam 105, in turn, intermittently acts on the one end of the hammer 106 to allow the other end thereof strike against the gong. The power required to operate such a motor actuated bell is relatively large due to the need for substantial torque to enable the hammer to generate a sufficiently large sound volume, when compared with a conventional electromagnetic bell and for this reason bells of this kind are not suitable for practical use.

SUMMARY OF THE INVENTION

It is, therefore, a principal object of the present invention to provide a motor actuated bell of the type which is capable of generating a bell sound of substantially large volume without the need for a greater motor torque.

Briefly, a motor actuated bell according to the invention is constructed in such a way as it can be operated under a relatively small motor torque by employing a gong striking mechanism utilizing a hammer connected to a slotted ring to which an angular moment is imparted from the motor torque through a suitable transmission means thereby causing the hammer to strike the associated gong in a rotational movement.

According to a broad aspect of the invention there is provided a motor actuated bell which comprises: a gong having an extrusion at an inner surface thereof; an electric motor having a drive shaft; transmission means for transmitting torque of said electric motor to a slotted ring to impart an angular moment to the ring, said transmission means having a projecting portion formed thereon to engage with the slot of the ring; a hammer for striking said gong at the extrusion of the inner surface in circular movement relation therewith; and a connecting member for operatively connecting said hammer to said slotted ring. Preferably, the transmission means comprises a worm gear fixedly mounted on the drive shaft of the electric motor, and a worm wheel adapted to mesh with the worm gear and having the projecting portion formed on the surface thereof to engage with the slot of the slotted ring. The projecting portion is preferably comprised of either two pins independently or integrally.

The foregoing and other objects, features and advantages of the present invention will become manifest to those versed in the art upon making reference to the detailed description and the accompanying sheets of drawings in which a preferred embodiment incorporating the principles of the present invention is shown by way of an illustrative example.

DESCRIPTION OF THE PREFERRED EMBODIMENT

Figure 1:
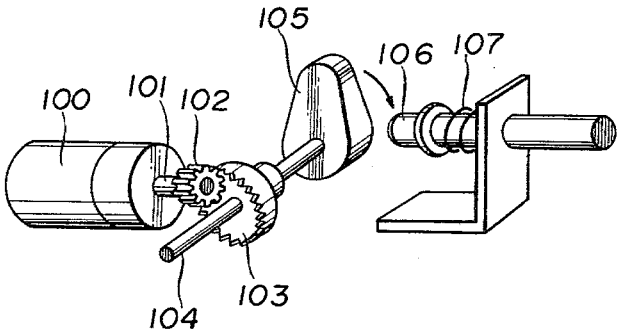
Fig. 1 (Prior Art)
FIG. 1 is a schematic perspective view of a motor actuated bell constructed in accordance with the prior art.
Figure 2:
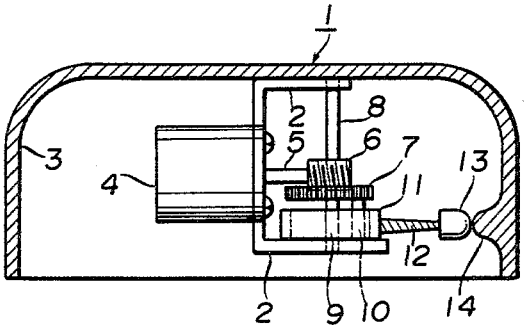
FIG. 2 is a cross-sectional view of a motor actuated bell according to a first embodiment of this invention.
Figure 3:
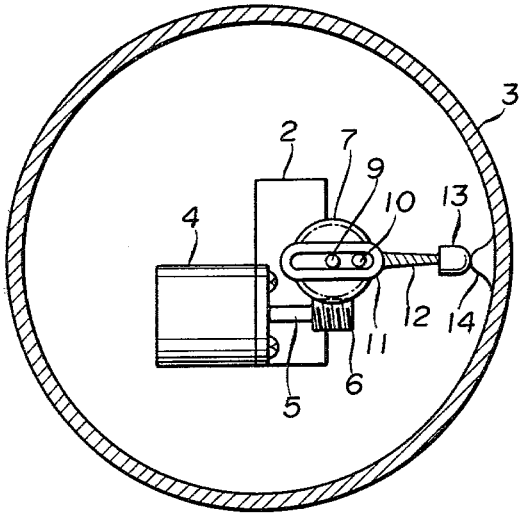
FIG. 3 is a bottom plan view of the bell as shown in FIG. 2.

FIGS. 2 and 3 show a motor actuated bell 1 constructed in accordance with a first embodiment of the invention. A mounting plate 2 fixed to the central portion of the inner wall of a gong 3 with an appropriate fixing means such as a bolt or nut is formed of such a shape as it accomodates each mechanical element which constitutes the motor actuated bell 1. The gong 3 having an extrusion at an inner surface thereof is made of iron in the form of a cup or a semisphere. An electric motor 4 is fixedly mounted on the mounting plate 2 by screws, the motor 4 having a shaft 5 capable of continuous rotation in accordance with its drive current. A worm gear 6 is fixedly mounted on the drive shaft 5 for rotation therewith and is operatively mated with a worm wheel 7 which is fixedly mounted on a supporting shaft 8 the upper surface of the worm wheel 7, the supporting shaft 8 being supported on the mounting plate 2 in rotational relation therewith. At the lower surface of the worm wheel 7, there is provided a center pin 9 which is fixedly secured to the lower surface of the worm wheel 7 for rotation therewith, the center pin 9 being rotatably supported in a bearing mounted on the mounted plate 2. In a radius direction apart from the center pin 9, a second pin 10 is fixedly attached to the surface of the worm wheel 7, the second pin 10 being the same construction as the center pin 9 except that this second pin 10 is not rotatably supported in a bearing as the center pin 9. These two pins 9 and 10 have preferably circular cross section respectively, and the diameters of each pin 9 and 10 are determined slightly smaller than the transverse width of a slot formed in a slotted ring 11. The slotted ring 11 is made in the form of an elongated ring and the slot formed in the ring 11 functions to couple the two pins 9 and 10 to the ring 11, while at the outer surface of the ring 11, more precisely, at the far most end in a longitudinal direction, a connecting member 12 is fixedly secured at one end of the member 12 to connect a hammer 13 at the other end thereof. The connecting member 12 may preferably be made from flexible material such as, for example, a plate spring or it may be made from a rigid body.

Figure 4:
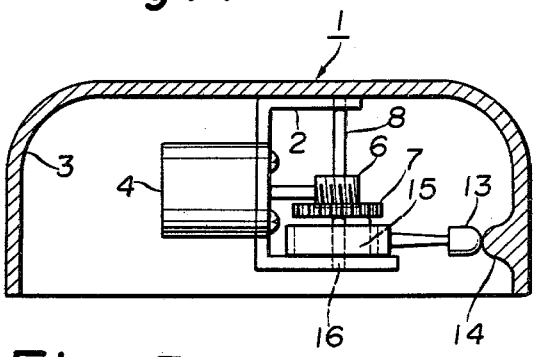
FIG. 4 is a cross-sectional view of a motor actuated bell according to a second embodiment of this invention.
Figure 5:
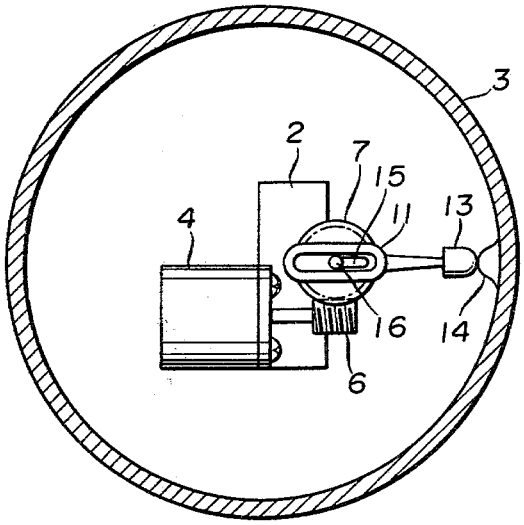
FIG. 5 is a bottom plan view of the bell as shown in FIG. 4.

Referring to FIGS. 4 and 5, there is shown a second embodiment of a motor actuated bell according to the invention. A large portion of the second embodiment is identical to that of FIGS. 2 and 3; thus, like elements are denoted by like numerals in FIGS. 4 and 5. Specifically, the difference in construction of the embodiments between the first embodiment and the second embodiment is that the center pin 9 and the second pin 10 are substituted for a new element, i.e., an integral pin 15. The integral pin 15 has substantially a flattened ellipse cross section, the bottom surface thereof being fixedly connected to the lower surface of the worm wheel 7 for rotation therewith to impart an angular moment to the ring 11, while the top surface having a pin 16 which is supported on a bearing formed in the mounting plate 2 so that the cam 15 is prevented from removing away from the integral pin 15.

The operation of the motor actuated bell thus constructed will be described.

Upon energization of the electric mode 4, its rotary shaft 5 is rotated so that the worm gear 6 is urged to rotate around the shaft 5. The worm gear 6 which is operatively mated with the worm wheel 7, in turn, urges to rotate the worm wheel 7 thereby causing the center pin 9 or the pin 16 to rotate around itself. As a result, the second pin 10 or the body of the integral pin 15 is allowed to rotate about the central pin 9 or the pin 16, so that the motor torque is imparted to the slotted ring 11 to have an annular moment. The hammer 13 is accordingly allowed to have the annular moment via the connecting member 12 so that the hammer 13 is rotated around the center pin 9 or the pin 16 to strike the associated gong 3 at the extrusion 14 in a rotational movement. Thus, the motor actuated bell according to the invention enjoys a large gong striking stroke which corresponds to a circular locus of the hammer around the center pin 9 or the pin 16, resulting in a large bell sound with a low driving power.

As is described above, it is a feature of the invention to provide a motor actuated bell in which a remakavely large gong striking stroke is given compared with a conventional motor actuated bell which adopt a reciprocal movement of the hammer relative to the gong.

Having described our invention as related to the embodiment shown in the accompanying drawings, it is our intention that the invention is not limited by any of the details of description, unless otherwise specified, but rather is construed broadly within its spirit and scope as set out in the accompanying claims.

What is claimed is:

1. A motor actuated bell which comprises:

a gong having an extension at a predetermined inner surface thereof;

an electric motor having a drive shaft;

transmission means for transmitting torque of said electric motor to a slotted ring to impart an angular moment to the ring, said transmission means having a projecting portion formed thereon to engage with the slot of the ring;

a hammer for striking said gong at the extrusion of the inner surface in circular movement relation therewith and a connecting member for operatively connecting said hammer to said slotted ring.

2. A motor actuated bell according to claim 1, in which said transmission means comprises a worm gear fixedly mounted on the drive shaft of the electric motor, and a worm wheel adapted to mesh with the worm gear and having the projecting portion formed on the surface thereof to engage with the slot of the slotting ring.

3. A motor actuated bell according to claim 2, in which said projecting portion is comprised of two pins alligned in a radius direction of the worm wheel respectively.

4. A motor actuated bell according to claim 2, in which said projecting portion is comprised of one integral pin.

* * * * *